US009945190B2

(12) United States Patent
Crowley et al.

(10) Patent No.: US 9,945,190 B2
(45) Date of Patent: Apr. 17, 2018

(54) ARTICULATING COMPONENT OF A DOWNHOLE ASSEMBLY, DOWNHOLE STEERING ASSEMBLY, AND METHOD OF OPERATING A DOWNHOLE TOOL

(71) Applicant: Smart Stabilizer Systems, Tewkesbury (GB)

(72) Inventors: Daniel Brendan Crowley, Tewkesbury (GB); Colin Walker, Derbyshire (GB)

(73) Assignee: Smart Stabilizer Systems Limited, Tewkesbury (GB)

( * ) Notice: Subject to any disclaimer, the term of this patent is extended or adjusted under 35 U.S.C. 154(b) by 421 days.

(21) Appl. No.: 14/422,841

(22) PCT Filed: Aug. 20, 2013

(86) PCT No.: PCT/GB2013/052194

§ 371 (c)(1),
(2) Date: Feb. 20, 2015

(87) PCT Pub. No.: WO2014/029985

PCT Pub. Date: Feb. 27, 2014

(65) Prior Publication Data

US 2015/0226020 A1 Aug. 13, 2015

(30) Foreign Application Priority Data

Aug. 20, 2012 (GB) ..... 1214784.9

(51) Int. Cl.
*E21B 17/20* (2006.01)
*E21B 7/06* (2006.01)
(Continued)

(52) U.S. Cl.
CPC ..... *E21B 17/20* (2013.01); *E21B 7/06* (2013.01); *E21B 7/067* (2013.01); *E21B 47/0006* (2013.01); *E21B 47/12* (2013.01)

(58) Field of Classification Search
CPC ... E21B 7/20; E21B 7/06; E21B 7/067; E21B 47/0006; E21N 47/12
(Continued)

(56) References Cited

U.S. PATENT DOCUMENTS 2,242,279 A 5/1941 Young
3,743,034 A 7/1973 Bradley
(Continued)

FOREIGN PATENT DOCUMENTS

CN 102606073 A 7/2012
GB 2347951 A 9/2000
(Continued)

OTHER PUBLICATIONS

International Search Report and Written Opinion received in corresponding PCT application No. PCT/GB2013/052194, dated Dec. 5, 2014.

*Primary Examiner* — David J Bagnell
*Assistant Examiner* — Nikhil Menon
(74) *Attorney, Agent, or Firm* — Blank Rome LLP

(57) ABSTRACT

This invention relates to an articulating component (16) of a downhole assembly, and to a downhole steering assembly. There is provided an articulating component (16) having a first end (40) and a second end (42), the articulating component being adapted to transmit torque between the first end and the second end. The articulating component has a pivotable coupling (46) between its first and second ends and at least one control element for the pivotable coupling, the control element(s) having an active condition in which the pivotable coupling is substantially locked against pivoting movement, and an inactive condition in which the pivotable coupling is unlocked. In a downhole steering assembly the articulating component is located downhole of the steering component whereby to protect the steering
(Continued)

component from unwanted vibrations generated downhole, or uphole of the steering component whereby to protect the steering component from unwanted vibrations generated uphole, or both.

25 Claims, 7 Drawing Sheets

(51) Int. Cl.
*E21B 47/00* (2012.01)
*E21B 47/12* (2012.01)

(58) Field of Classification Search
USPC ..... 175/40
See application file for complete search history.

(56) References Cited

U.S. PATENT DOCUMENTS 4,270,619 A * 6/1981 Base ..... E21B 17/1014 175/325.4
4,811,798 A 3/1989 Falgout, Sr. et al.
4,895,214 A 1/1990 Schoeffler
7,445,059 B1 11/2008 Falgout, Sr.
2007/0289373 A1 12/2007 Sugiura
2008/0271925 A1 11/2008 Misselbrook et al.
2009/0032302 A1* 2/2009 Downton ..... E21B 47/024 175/38
2011/0139513 A1* 6/2011 Downton ..... E21B 7/062 175/61
2011/0308858 A1* 12/2011 Menger ..... E21B 7/067 175/24
2012/0018225 A1 1/2012 Andreas et al.
2012/0043133 A1 2/2012 Millet

FOREIGN PATENT DOCUMENTS

GB 2438718 A 12/2007
GB 2451571 A 2/2009
WO 2009085753 A2 7/2009

* cited by examiner

ARTICULATING COMPONENT OF A DOWNHOLE ASSEMBLY, DOWNHOLE STEERING ASSEMBLY, AND METHOD OF OPERATING A DOWNHOLE TOOL

FIELD OF THE INVENTION

This invention relates to an articulating component of a downhole assembly, to a downhole steering assembly, and to a method of operating a downhole tool. The articulating component can be used for other than downhole steering applications but it is expected to find its greatest utility as part of a downhole steering assembly. Most of the following description will therefore relate to steering applications.

BACKGROUND TO THE INVENTION

When drilling for oil and gas, it is desirable to steer the drill bit in a chosen direction, notwithstanding that the drill bit and other components of the downhole steering assembly might be several kilometers below the Earth's surface. Downhole steering assemblies, which can achieve the desired directional drilling, are in widespread use, and can often drill complex borehole paths in which the trajectory of the drill bit is controlled during the drilling operation.

Directional drilling is complicated by the necessity to operate the downhole steering assembly within harsh borehole conditions. The steering apparatus is typically disposed near the drill bit. In order to obtain the desired real-time directional control, it is preferred to operate the steering apparatus remotely from the surface of the Earth. Furthermore, the steering apparatus must be operated to maintain the desired path and direction regardless of its depth within the borehole and whilst maintaining practical drilling speeds. Finally, the steering apparatus must reliably operate under exceptional heat, pressure and vibration conditions that will typically be encountered during the drilling operation.

Directional drilling applications require the drill string, or parts of the downhole steering assembly, to articulate and/or be flexible so as to pass along the curved borehole. Many prior art documents disclose components suitable for use in directional drilling. U.S. Pat. No. 4,904,228 in particular describes a universal ball joint permitting articulation of respective parts of a downhole assembly. U.S. Pat. No. 5,503,236 describes another universal joint mounted adjacent to the drill bit. U.S. Pat. No. 4,880,067 describes a downhole assembly including a number of articulating sections, the articulating sections carrying a flexible drive shaft which connects the output shaft of a downhole motor to the drill bit.

U.S. Pat. No. 2,740,651 describes a drill bit which is mounted by way of a resilient flexible coupling. U.S. Pat. No. 3,135,103 describes a flexible joint for a drill string. U.S. Pat. No. 3,446,297 describes a flexible drill collar. U.S. Pat. Nos. 2,402,003 and 3,578,029 disclose flexible pipes suitable for use in drill strings.

U.S. patent application 2011/0308858 discloses a flexible joint which can be used in a downhole steering assembly. The flexible joint has a constant velocity coupling and a spring which acts upon the coupling. The spring can be used to adjust the force which is required to bend the constant velocity joint, and also to adjust the maximum angle through which the joint can be articulated.

Many types of steering apparatus are known. A common type of steering apparatus comprises a downhole motor disposed in a housing with a longitudinal axis, at least part of which axis is offset or displaced from the axis of the borehole. The motor can be of a variety of types including electric and hydraulic. Hydraulic motors which operate by way of the circulating drilling fluid are commonly known as a "mud" motors. The drill bit is attached to the output shaft of the motor, and is rotated by the action of the motor. The axially offset motor housing, commonly referred to as a bent subsection or "bent sub", provides axial displacement that can be used to change the trajectory of the drill bit. By rotating the drill bit with the motor and simultaneously rotating the motor housing with the drill string, the orientation of the housing offset continuously changes and the path of the advancing borehole is maintained substantially parallel to the axis of the drill string. By rotating the drill bit with the motor only, the path of the borehole is deviated from the axis of the non-rotating drill string in the direction of the offset of the bent sub. By alternating these two methodologies of drill bit rotation, the path of the borehole can be controlled. A more detailed description of directional drilling using the bent sub concept is disclosed in U.S. Pat. Nos. 3,260,318, and 3,841,420.

It is a recognised disadvantage of a downhole steering assembly using a bent-sub that the drill bit is required to drill an over-large hole whilst drilling a linear section of borehole. It is another disadvantage that the drill string must not rotate when a curved section of borehole is being drilled, which increases the frictional resistance to the advance of the drill bit along the borehole. Furthermore, the degree of curvature is fixed by the bend of the housing, so that the operator must choose the optimum bend angle dependent upon the expected drilling conditions and the borehole curvature required.

UK patent applications 2 435 060 and 2 440 024 describe alternative methods of steering a drill bit by way of the bent housing of a downhole motor. These documents address the second disadvantage stated above by allowing the drill string to rotate continuously. There is a rotatable connection between the drill string and the bent sub. A clutch mechanism is provided within the rotatable connection, the clutch mechanism controlling the orientation of the bent sub and consequently the orientation of the bend.

Another type of steering apparatus comprises a steering component such as that described in our published European patent 1 024 245. This steering component allows the drill bit to be moved in any chosen direction, i.e. the direction (and degree) of curvature of the borehole can be determined during the drilling operation, and as a result of the measured drilling conditions at a particular borehole depth. Downhole steering assemblies incorporating steering components such as that of EP 1 024 245 avoid the disadvantages of the bent-sub assemblies described above.

However, steering components such as those of EP 1 024 245 are necessarily mechanically complex. It is a known concern for some operators that mechanically complex steering components such as those of EP 1 024 245 can be damaged by vibrations and the like. It will be appreciated that the forces acting upon a downhole steering assembly are considerable, and whilst the steering component can be manufactured to withstand the expected forces, unexpected and excessive forces can be experienced during uncontrolled vibrations within the downhole steering assembly.

It is necessary for the downhole steering assembly to be sufficiently stiff or rigid to communicate the torque to drive the drill bit, and also to communicate the lateral steering forces from the steering component to the drill bit. However, this inherent rigidity increases the likelihood that vibrations occurring at the drill bit will be communicated to the steering component. If the vibrations are close to the resonant frequency of a part of the downhole assembly the vibrations which are communicated to the steering assembly can be large and damaging.

The operator at the surface will typically monitor the status of the downhole steering tool continuously during use, and will seek to identify unwanted vibrations. The steering assembly can for this purpose carry accelerometers for example adapted to detect unwanted vibrations, the output of the accelerometers being communicated to the surface. The vibrations can be generated adjacent to the drill bit, or they can be generated within the downhole motor or drill string. The steering assembly can therefore experience unwanted vibrations reaching it from downhole or uphole, or both. If unwanted vibrations occur, the operator will typically seek to eliminate the vibrations, or at least disrupt their development, by reducing the weight on bit or by adjusting the rate of rotation of the drill string and/or the drill bit, or by all of these. The onset of damaging vibrations can be very rapid, however, and the vibrations can damage a steering component before they are eliminated.

SUMMARY OF THE INVENTION

The present invention seeks to provide an articulating component of a downhole assembly which is adapted to reduce the vibrations which are communicated through the downhole assembly. In the case of a downhole steering assembly the articulating component can be located between the drill bit and the steering component whereby to reduce the likelihood of vibrations arising downhole of the steering component, particularly damaging vibrations, being communicated to the steering component. Alternatively or additionally, the articulating component can be located between the drill string and the steering component whereby to reduce the likelihood of vibrations arising uphole of the steering component, particularly damaging vibrations, being communicated to the steering component. The steering component can thereby be protected from significant and damaging vibrations.

According to the invention there is provided an articulating component of a downhole assembly, the articulating component having a first end and a second end, the articulating component being adapted to transmit torque between the first end and the second end, the articulating component having a pivotable coupling between its first and second ends and at least one control element for the pivotable coupling, the control element(s) having an active condition in which the pivotable coupling is substantially locked whereby to permit minimum pivoting of the coupling, and an inactive condition in which the pivotable coupling is unlocked whereby to permit pivoting of the coupling.

In its active condition the articulating component is substantially rigid, so that it is able to communicate lateral forces between its first and second ends. In a preferred application, the articulating component is located between a drill bit and a steering component, and in its active condition acts as a substantially rigid pipe which is able to communicate drilling torque to the drill bit, and lateral steering forces to the drill bit.

In its inactive condition the component is substantially flexible or compliant under lateral loads. Thus, whilst torque can still be communicated between its ends (so that the drill bit continues to rotate), lateral forces are not communicated, or are at least reduced during communication through the articulating component. It is the uncontrolled lateral forces which occur during vibrations which can be damaging to a sensitive component of the downhole assembly, and so the elimination or reduction of the vibrations which are communicated to the sensitive component can reduce the likelihood of damage to that component.

Preferably, the at least one control element includes a plurality of pistons which are movably located within respective cylinders. Desirably, the cylinders are filled with hydraulic fluid, each cylinder being connected to a circuit for the hydraulic fluid whereby the cylinders can be hydraulically connected. Preferably, the pistons are located at spaced locations around the articulating component, the pistons each engaging a part of the pivotable coupling.

Desirably, the circuit for the hydraulic fluid includes at least one valve, the at least one valve having an open condition in which fluid can flow between the respective cylinders, and a closed condition in which fluid flow between the respective cylinders is substantially prevented.

Accordingly, when the at least one valve is open one or more of the pistons can be pushed out if its cylinder at the same time as an opposing piston is being pushed into its cylinder. The pivotable coupling can therefore be substantially free to pivot, with the pistons moving relative to their respective cylinders as required. When the valve is closed, however, the volume of each cylinder is substantially fixed and the pistons cannot move. The pivotable coupling is therefore substantially locked and the articulating component is substantially rigid.

Desirably, there are three or more pistons substantially equally spaced around the articulating component. Preferably, there are six pistons substantially equally spaced around the articulating component.

Desirably, a set of pistons is substantially aligned in a single plane, the plane being radial to the longitudinal axis of the articulating component, whereby the pistons in each set act upon the same part of the pivotable coupling. Preferably, there are two, three or four sets of substantially aligned pistons lying in two, three or four planes respectively.

In articulating components having more than one set of aligned pistons, the pistons in one set are preferably longitudinally aligned with pistons in the other set(s). This allows a linear fluid conduit (which is aligned with the longitudinal axis of the articulating component) to communicate fluid to pistons of all of the sets and simplifies the internal structure of the component.

Preferably, the number of valves is equal to the number of pistons in each set of aligned pistons. In a component having only one set of aligned pistons, there is a valve for each piston. The provision of multiple valves increases the rigidity of the articulating component in its active condition, i.e. it reduces the likelihood that one leaking valve will reduce the rigidity of the articulating component significantly.

Alternatively, the control element is biased to its active condition by a resilient biasing means, and is retained in its active condition by a detent mechanism. In such embodiments the control element can be moved to its inactive condition by a force which exceeds the bias of the resilient biasing means and the resistance of the detent mechanism. Such embodiments can therefore provide an automatically operating articulating component, i.e. an articulating component which is normally locked against articulation but which can articulate when a threshold force is exceeded. It can be arranged that the threshold force is sufficiently large that the articulating component remains locked during normal drilling operations, but is small enough to protect a sensitive component from damage.

There is also provided a downhole steering assembly comprising a drill bit, a steering component adapted to deviate the drill bit from a linear path, and an articulating component having a first end connected to the steering component and a second end connected to the drill bit, the articulating component being adapted to transmit torque between the steering component and the drill bit, the articulating component having a pivotable coupling between its first and second ends, and at least one control element for the pivotable coupling, the control element having an active condition in which the pivotable coupling is substantially locked whereby to permit minimum pivoting of the coupling, and an inactive condition in which the pivotable coupling is substantially unlocked whereby to permit relative pivoting of the coupling.

Preferably, the articulating component is a first articulating component and the downhole steering assembly has a similar second articulating component, the steering component being located between the first and second articulating components. Accordingly, the second articulating component is located between the drill string and the steering component, and can serve to limit the effect upon the steering component of any vibrations which arise within the drill string uphole of the steering component.

It will be understood that the articulating component can be used in downhole assemblies other than downhole steering assemblies. For example, it may be desired to protect a measurement-while-drilling tool from excessive vibrations which might otherwise damage the sensors located within the tool.

The articulating component has been designed primarily to provide a controllably compliant joint within the downhole assembly, whereby to eliminate or reduce the communication of vibrations within the downhole assembly. However, the articulating component has the additional benefit of permitting an increase in the maximum borehole curvature which can be achieved. Specifically, the articulating component in its inactive condition permits greater curvature of the downhole assembly, and in particular greater curvature between the steering component and the drill bit, than is available with the articulating component in its active condition. The articulating component can therefore be used to increase the borehole curvature during directional drilling.

BRIEF DESCRIPTION OF THE PREFERRED EMBODIMENTS

The invention will now be described in more detail, by way of example, with reference to the accompanying drawings, in which.

DETAILED DESCRIPTION

Figure 1:
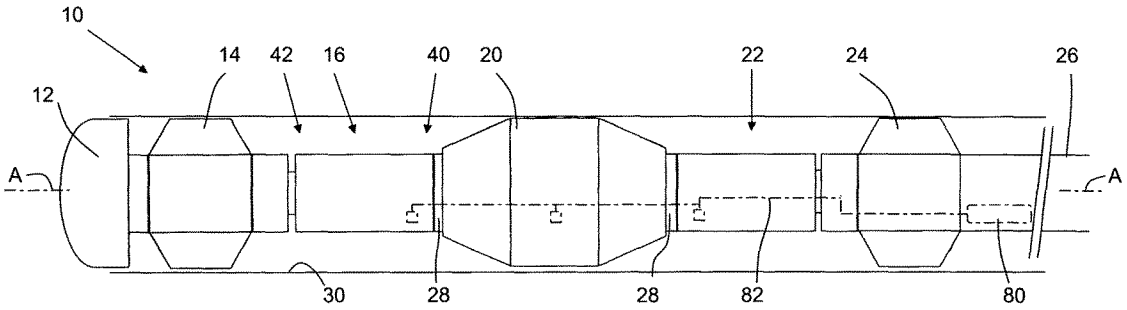
FIG. 1 shows a side view of a downhole steering assembly according to the present invention, during drilling of a substantially linear section of borehole.

FIG. 1 shows a downhole steering assembly 10 according to the present invention. It will be understood from the above description that the present invention has particular utility in steering applications such as that shown in FIG. 1.

The downhole steering assembly 10 comprises a drill bit 12, a near-bit stabilizer 14, a first articulating component 16, a steering component 20, a second articulating component 22, and a drill string stabilizer 24. The drill string stabilizer 24 is connected to the drill string 26, which is in turn connected to drilling equipment located at the Earth's surface.

It will be understood that the presence, and positioning, of the stabilizers 14 and 24 are optional, and outside the scope of the present invention.

Whilst not essential to the present invention, the steering component 20 is ideally constructed according to the disclosure of EP 1 024 245, and has an array of control pistons (not shown) by which the shaft 28 can be driven away from the longitudinal axis A-A of the borehole 30. Whilst FIG. 1 depicts the longitudinal axis A-A as being horizontal, it will be understood that the axis can be at any angle.

Figure 2:
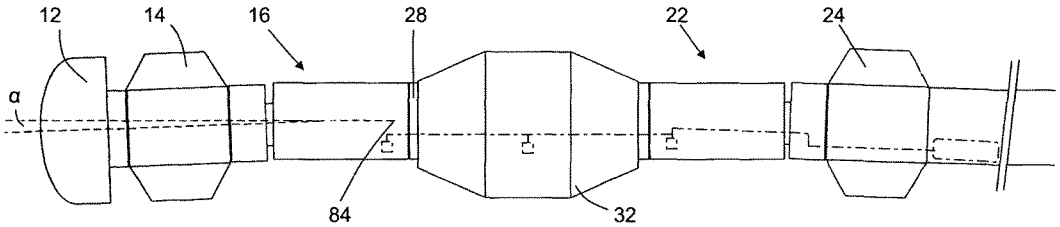
FIG. 2 shows the assembly of FIG. 1 during drilling of a curved section of borehole.

When it is desired to deviate the drill bit from a linear path, the steering component 20 is activated as shown in FIG. 2. In this embodiment the steering component is driving the shaft 28 to be moved upwardly as drawn, so that whilst the sleeve 32 of the steering component 20 remains substantially aligned with the longitudinal axis A-A (i.e. constrained by the borehole 30), the shaft 28 is moved upwardly. One end of the shaft 28 is connected to the first articulating component 16, which is thereby also driven upwardly as drawn. The near-bit stabilizer 14 acts to centralize the drill shaft 34 within the borehole 30, and so the downhole assembly 10 is forced to deform or bend to accommodate the lateral movement of the shaft 28. The drill bit 12 adopts an angle $\alpha$ which is a few degrees away from the longitudinal axis A-A, which causes the drill bit 12 to deviate the borehole in a downwards direction as drawn.

Figure 3:
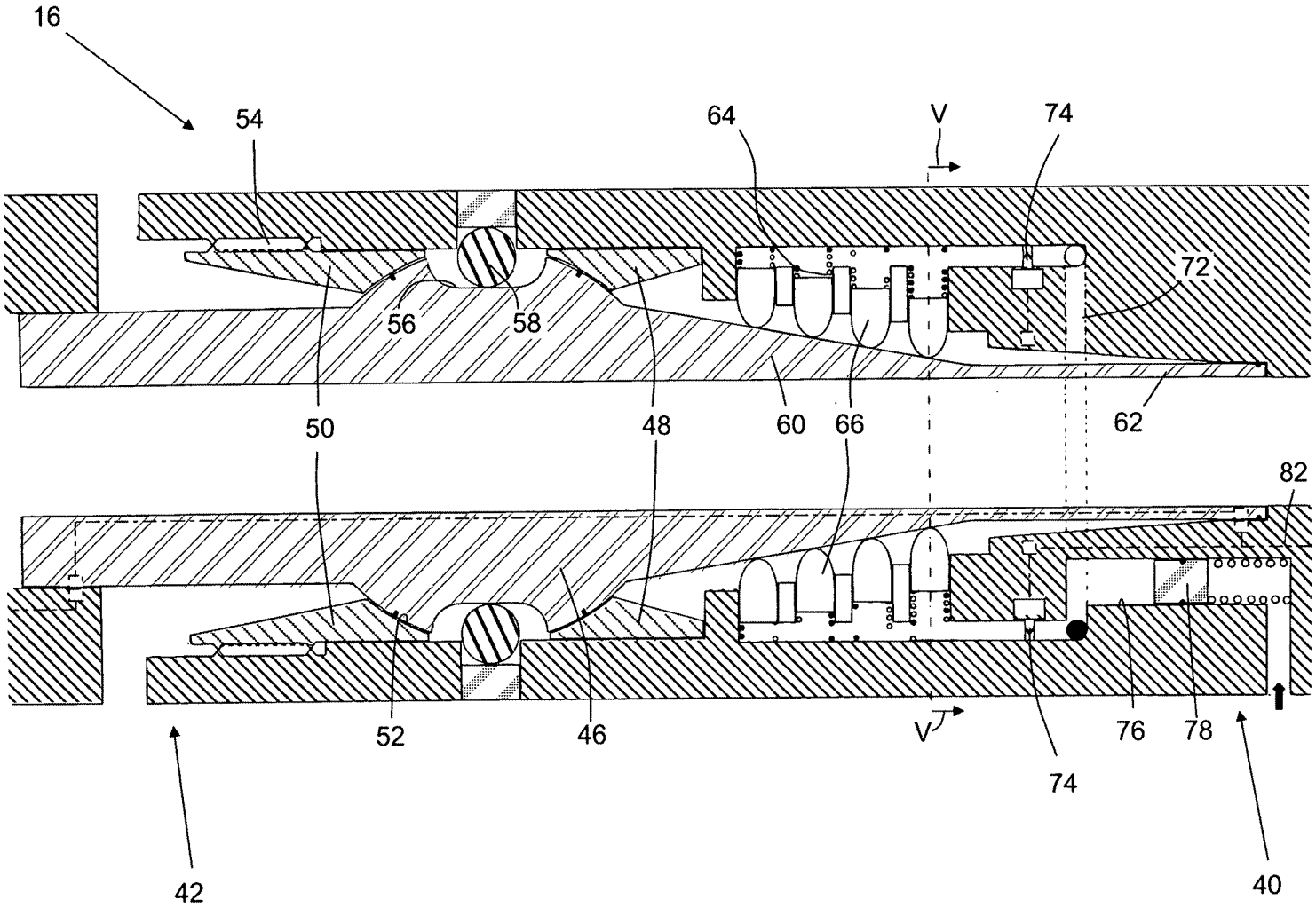
FIG. 3 shows a sectional view of a first embodiment of articulating component according to the present invention, when drilling a linear borehole.
Figure 4:
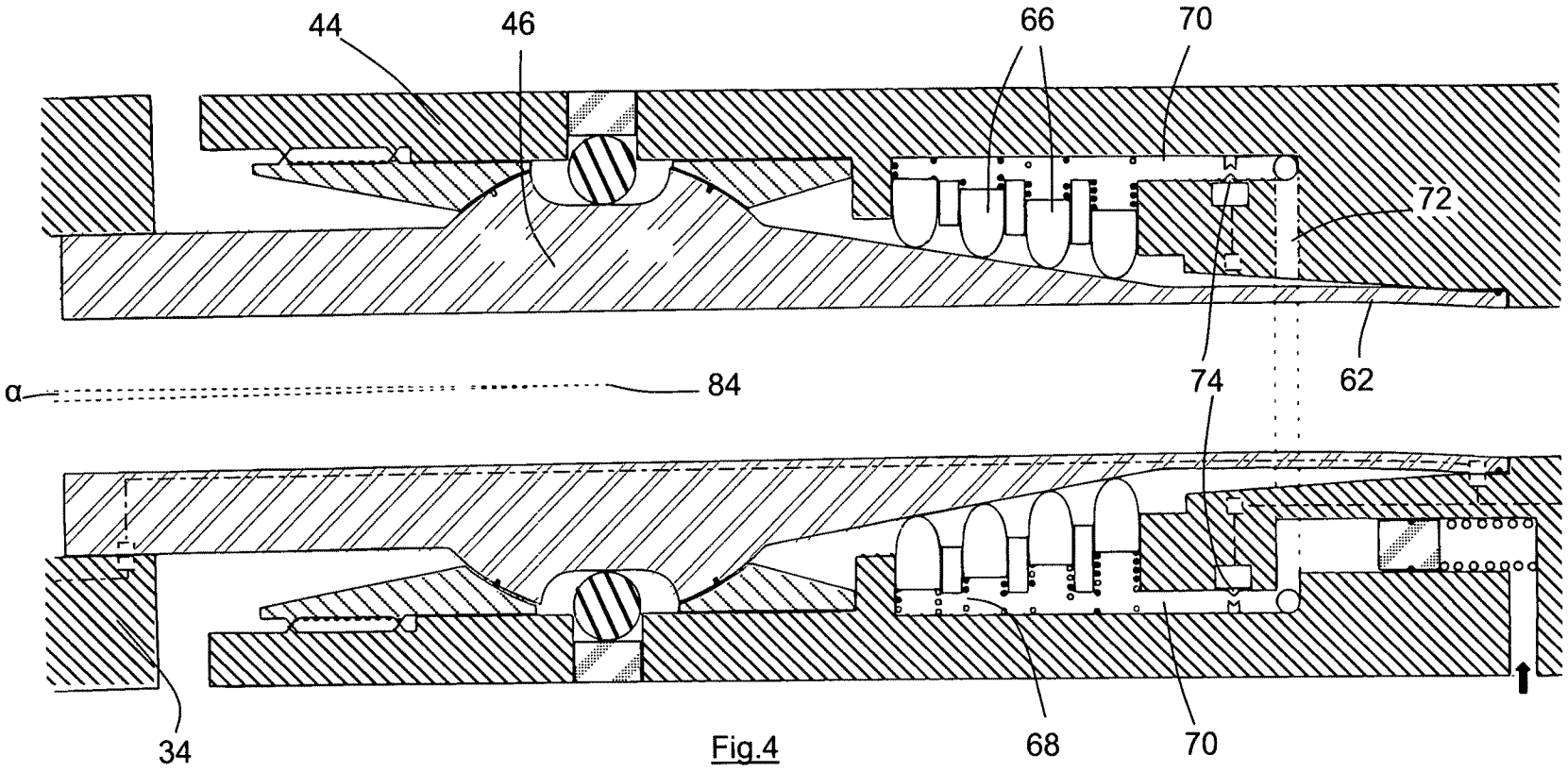
FIG. 4 shows a view as FIG. 3, when drilling a curved borehole.

The detailed structure of one embodiment of the first articulating component 16 is shown in FIGS. 3 and 4. The first articulating component 16 has a first end 40 and a second end 42, which in this embodiment are connected (preferably by suitably threaded connectors, not shown) to the shaft 28 of the steering component 20, and to the drill shaft 34, respectively.

The first articulating component 16 has a housing 44 which contains a pivotable or articulating body 46. The articulating body 46 is located within the housing 44 by a first insert 48 and a second insert 50, both of which have a spherical thrust face 52 adapted to engage the spherical surface of the articulating body 46. The second insert 50 is threaded and is secured by way of a correspondingly threaded part 54 of the housing 44.

The articulating body 46 has a number of recesses 56 within which are located respective rollers 58. Only two of the recesses 56 and the corresponding rollers 58 are seen in FIGS. 3 and 4, but it will be understood that the recesses and rollers are located around the articulating body 46 so as to provide a universal joint (or ideally a constant velocity joint).

It will therefore be understood that torque can be communicated from the drill string 26 (and from a downhole motor if present), through the shaft 28, through the first articulating component 16, through the drill shaft 34, and to the drill bit 12. Drilling fluid can also be communicated to the drill bit 12 through the drill string 26 and downhole steering assembly 10, in known fashion.

The articulating body 46 includes an extension 60, 62. The housing 44 has a number of cylinders 64, each of which accommodates a respective piston 66. The pistons 66 are biased outwardly of their cylinders 64 by respective compression springs 68. Each of the pistons 66 engages the extension 60. There is a bank of four pistons 66 arranged along the length of the extension 60, and, as will be understood from FIG. 5, there are six pistons 66 in each set of pistons aligned in a plane around the extension 60, so that there are twenty four pistons 66 in total.

Figure 5:
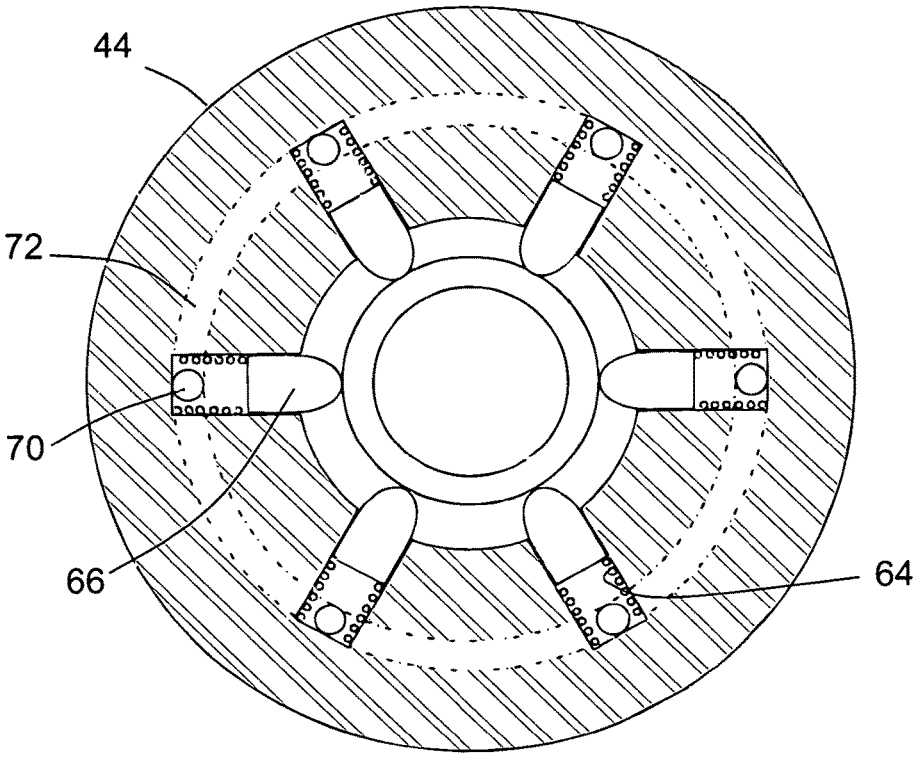
FIG. 5 shows a cross-sectional view along the line V-V of FIG. 3.

The word "bank" will be used herein to describe a group of pistons/cylinders which are aligned along the longitudinal axis of the articulating component, and the word "set" will be used herein to describe a group of pistons/cylinders which are aligned in a plane substantially perpendicular to the longitudinal axis A-A. Accordingly, FIGS. 3 and 4 show two banks of pistons, and FIG. 5 shows one set of pistons.

One piston in each set of pistons is aligned with a piston in the other sets, so that six linear conduits or galleries 70 (see FIG. 4 and FIG. 5) can communicate hydraulic fluid to the cylinders 64, one linear conduit 70 being provided for each bank of cylinders 64. The conduits 70 are all connected to a circular manifold or gallery 72 whereby all of the cylinders 64 can be hydraulically interconnected.

A valve 74 is located in each of the conduits 70. Since the valves 74 are located between the manifold 72 and the respective cylinders 64, when the valves 74 are closed each bank of cylinders 64 is hydraulically isolated from the other banks of cylinders. Thus, in the active condition of the first articulating component 16, with the valves 74 closed, the engagement of the pistons 66 with the extension 60 substantially prevents relative pivoting of the articulating body 46.

In this active condition the first articulating component provides a substantially rigid connection between the steering component 20 and the drill bit 12, and this is the normal operating condition for the first articulating component.

If, however, the drill bit experiences excessive or unwanted vibrations, especially vibrations with a frequency close to the resonant frequency of a part of the downhole assembly 10, it is desirable to prevent those vibrations being communicated to the steering component 20. To achieve this, the first articulating component 16 is transferred to its inactive condition, i.e. the valves 74 are all opened. This permits hydraulic fluid to flow through the manifold 72, between respective banks of cylinders 64. The pistons 66 at one side of the articulating component 16 can therefore be pushed into their respective cylinders, as the opposing pistons 66 are pushed out of their respective cylinders, and vice versa.

As seen in FIG. 4, the extension 62 of the articulating body 46 is sufficiently flexible to bend in order to accommodate the pivoting of the articulating body 46.

As the pistons 66 move within their cylinders 64, the articulating body 46 is substantially free to pivot, whereby the unwanted vibrations of the drill bit 12 are converted into pivoting movement of the first articulating component 16 rather than being communicated to the steering component 20. Alternatively stated, the energy of the unwanted vibrations is largely absorbed by the first articulating component 16, primarily as heat due to the pumping losses within the hydraulic circuit (it will be understood that as the downhole steering assembly 10 rotates, the plane of the deflection of the articulating body 46 will change continuously, so that each bank of pistons 64 will be in a state of continuous reciprocation as rotation proceeds, over and above any piston movement caused by the unwanted vibrations).

It will be understood that whilst the first articulating component 16 in its inactive condition is more compliant than when in its active condition, it is not totally compliant, i.e. it retains some rigidity due to the force required to cause the pivoting of the articulating body 46. However, its rigidity is significantly reduced, and this is expected to reduce or eliminate the communication of damaging vibrations from the drill bit 12 to the steering component 20.

As shown in FIGS. 3 and 4, the manifold 72 is connected to a balancing cylinder 76 which contains a balancing piston 78. The balancing cylinder 76 is open to the drilling fluid within the borehole 30, and the balancing piston 78 thereby serves to isolate the hydraulic fluid from the drilling fluid while minimising the pressure differential therebetween.

The valves 74 can be controlled (together) by a controller 80 (FIG. 1). At least one sensor such as an accelerometer (not shown) is located in the downhole assembly 10, preferably immediately adjacent to the drill bit 12. The sensor(s) can detect unwanted vibrations within the downhole steering assembly 10, and communicate this to the controller 80.

The controller 80 communicates with the valves 74 by way of electrical wires 82, the valves 74 in this embodiment comprising respective solenoids adapted to open the valves 74 when a control signal is received from the controller 80. The control signal is issued when the sensor(s) indicates that a predetermined threshold acceleration has been reached. Actuation of the device can therefore in this embodiment be automated and can be controlled downhole, avoiding any delay in awaiting a control signal from the surface, during which delay damaging vibrations might otherwise be communicated to the steering component 20.

It is nevertheless expected that a signal will be sent to the surface to indicate that the threshold acceleration has been reached, and that the first articulating component has transferred to its inactive condition. The operator can take the necessary steps to disrupt the unwanted vibration and prevent its continuance.

In another embodiment the downhole tool does not have a controller, and the assessment of the vibrations is undertaken at the surface. In this embodiment the measurements of acceleration are communicated to the surface where they are compared with the predetermined threshold. If the predetermined threshold is exceeded a control signal can be sent from the surface to actuate the valves. In this embodiment the articulating component is transferred to its inactive condition, and also transferred to its active condition, by respective control signals from the surface. Such embodiments are less preferred than the embodiment shown in the drawings, however, because of the delay which will necessarily occur in transferring the articulating component to its inactive condition.

In a further alternative embodiment, the downhole tool has a controller and more than one mode of operation, the modes of operation differing in the way in which the transfer of the articulating component between its active and inactive conditions is controlled. Such an embodiment may be operable in an "automatic" mode, with the articulating component being transferred between its active and inactive conditions by the downhole controller without any input from the surface. It may, however, be determined that under certain conditions it is preferable to assume control over the articulating component from the surface, in which case a signal can be sent to the controller to change or suspend the action of the controller and place the articulating component in a "manual" mode. In the manual mode, the signals to transfer the articulating component between its active and inactive conditions are issued by the surface equipment. Such a tool can also have a third operating mode, namely "semi-automatic", in which the downhole controller is responsible for transferring the articulating component to its inactive condition when the predetermined threshold is exceeded, but with the signal to return the articulating component to the active condition being issued from the surface. The surface equipment can communicate with the downhole controller and instruct the controller to switch between the operating modes as required, ideally without suspending the operation of the downhole tool. Such an embodiment will provide the advantages of automated operation of the articulating component with the benefit of a full or partial over-ride from the surface if the conditions require that.

When the unwanted vibration has ceased (which might be determined downhole by the controller 80, or determined by the operator at the surface, as applicable), the valves 74 can be closed so as to return the first articulating component 16 to its active condition. It is desirable that the valves 74 are only closed when the first articulating component 16 is in a substantially linear configuration as shown in FIG. 3. It is not necessary that all of the valves 74 be closed together, and one opposed pair of valves can be closed to isolate respective banks of cylinders 64 before the other opposed pairs are closed, so as to allow the first articulating component 16 to adopt the substantially linear configuration.

It will be understood that FIG. 2 shows the first articulating component 16 in its inactive condition, i.e. most of the required bending between the steering component 20 and the near-bit stabilizer 14 is occurring within the first articulating component 16. During normal drilling on the other hand, the first component 16 will be substantially rigid and substantially linear, so that the shaft 28 would undergo most of the required bending as the drill bit 12 is deviated. The shaft 28 is designed to bend for this purpose, and the location of the bend within the shaft 28 provides the effective pivot point for the deviation of the drill bit. FIG. 2 demonstrates, however, that allowing the first articulating component 16 to adopt its inactive condition and thereby permitting the first articulating component 16 to bend, will move the pivot point 84 towards the drill bit 12, and thereby increase the degree of curvature which is available. As shown in FIG. 4, when the first articulating component 16 is in its inactive condition, the pivot point 84 is located at the center of the part-spherical surface of the articulating body 46.

The maximum deflection of the articulating body 46 is dependent upon the magnitude of the applied bending load, the stiffness of the piston springs 68, the stiffness of the articulating body 46 and (when the downhole steering assembly 10 is rotating) the flow area of the valves 74. Modulation of the flow area of the valves is, therefore, a means to control the maximum deflection and thus the maximum bit tilt angle $\alpha$. Accordingly, the valves 74 are not merely able to adopt an open or closed position, but can adopt partially open positions also, whereby to control the maximum deflection.

It will be seen from FIGS. 1 and 2 that the downhole steering assembly 10 in this embodiment includes an optional second articulating component 22, which can be constructed identically to the first component 16. The second articulating component 22 is connected to the other end of the shaft 28 of the steering component 20. Whilst the second articulating component 22 is shown in a reversed orientation to the first articulating component 16, this is not necessary. It will be understood that the second articulating component provides a controllably compliant joint between the steering component 20 and the drill string 26, and can therefore isolate the steering component from unwanted vibrations occurring uphole. In other embodiments the second articulating component 22 could be located farther from the steering component 20 if desired, and can isolate the steering component from vibrations induced by a downhole motor if present.

Figure 6:
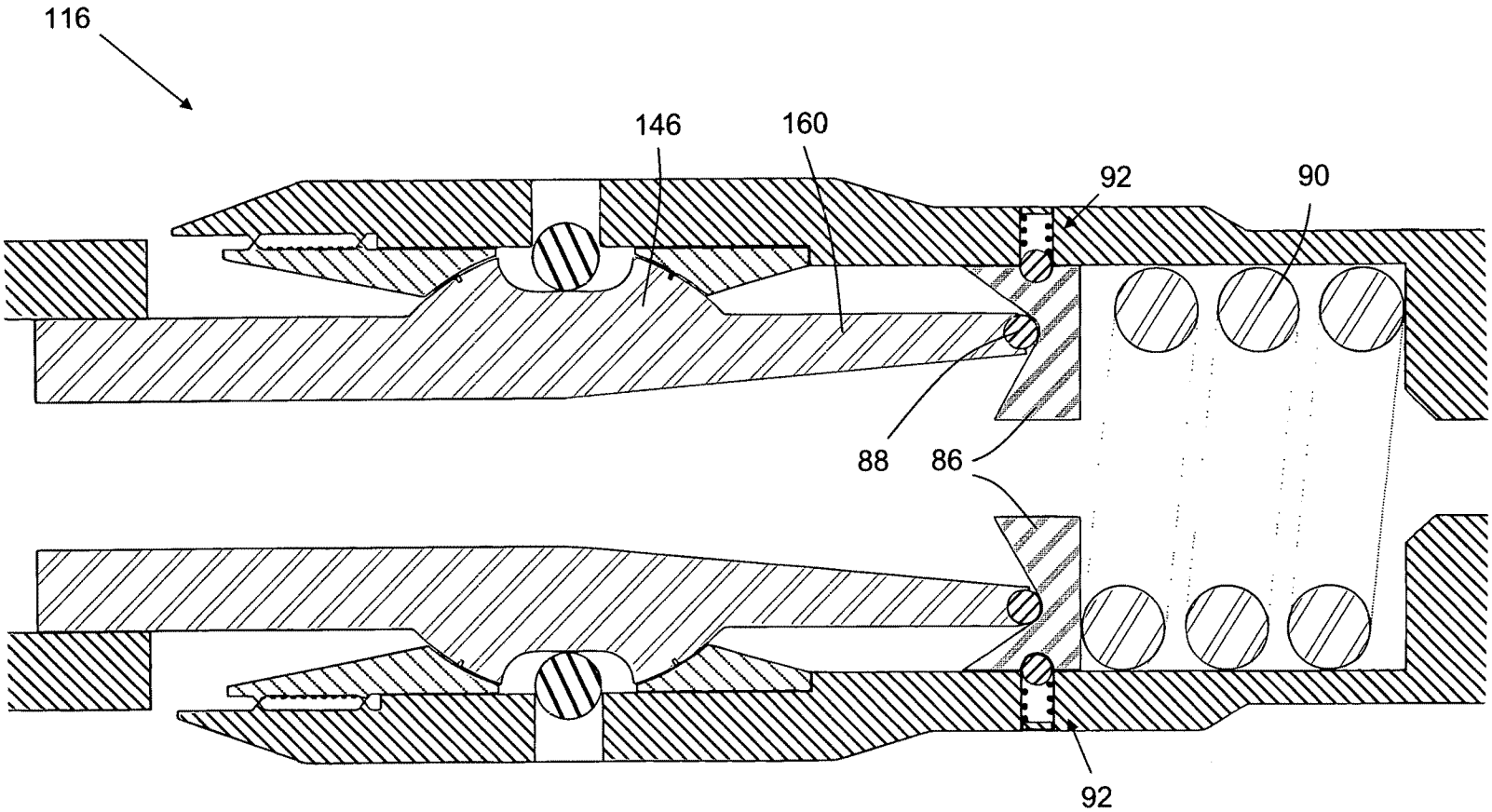
FIG. 6 shows a sectional view of a second embodiment of articulating component according to the present invention, when drilling a linear borehole.
Figure 7:
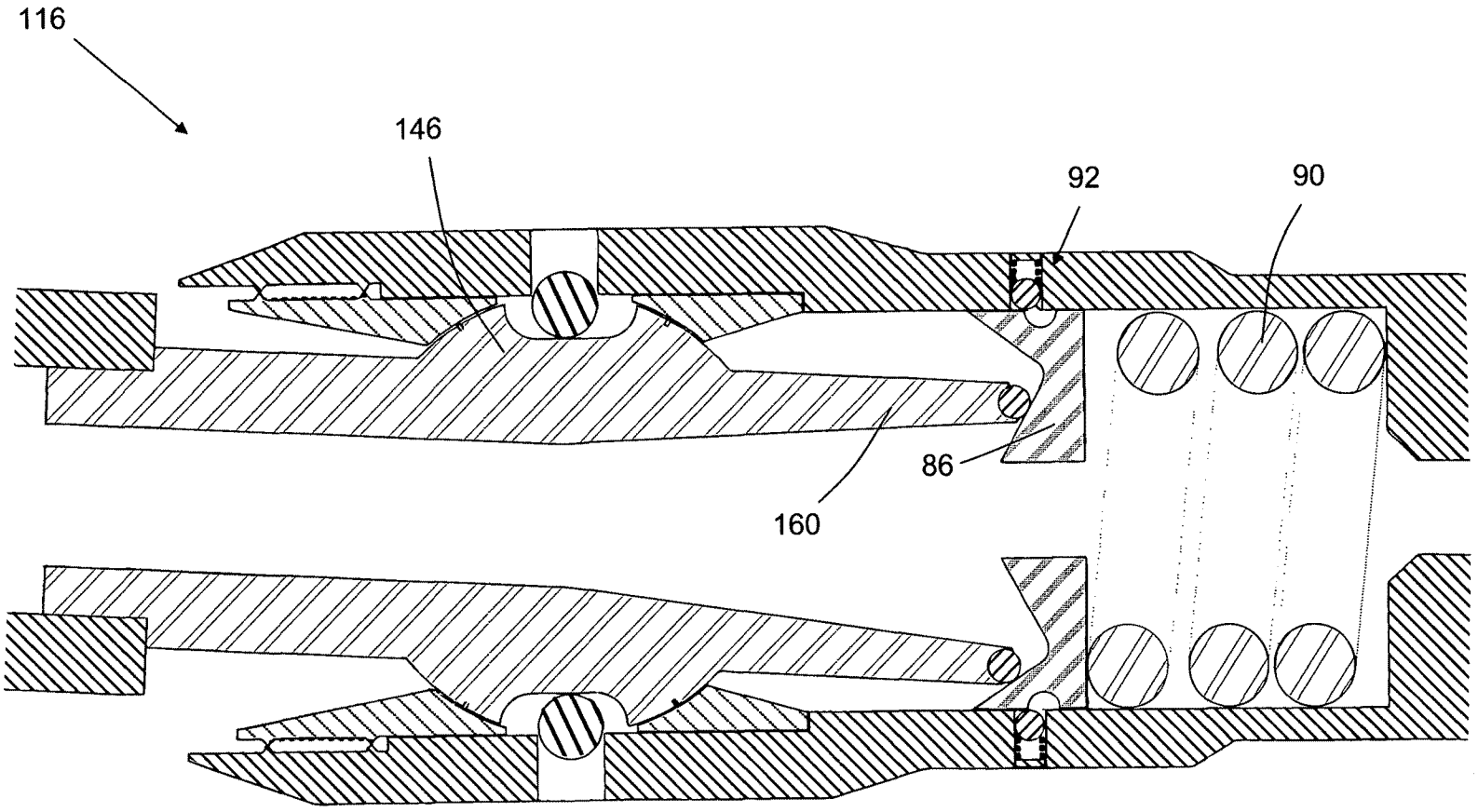
FIG. 7 shows a view as FIG. 6, when drilling a curved borehole.

In the alternative embodiment of FIGS. 6 and 7 the articulating component 116 operates automatically rather than under the control of a controller. In this embodiment the control element is an annular collar 86 which engages the end of an extension 160 of an articulating body 146. The collar 86 is formed as a "cupped" shape so as better to locate a set of rollers 88 mounted to the end of the extension 160.

The control element 86 is biased to the left as drawn in FIGS. 6 and 7 by a compression spring 90, and in its active condition as shown in FIG. 6 it is engaged by a number of detent mechanisms 92.

During normal drilling operations torque is transmitted by the articulating component 116 to the drill bit as with the previous embodiment. Also, since the articulating body 146 is substantially locked against pivoting movement any lateral forces can be communicated from a steering component to the drill bit.

It will be understood, however, that the articulating body 146 can be forced to articulate, i.e. to move to a position such as that shown in FIG. 7, by a lateral force which exceeds the force required to compress the spring 90, and to overcome the resistance of the detent mechanisms 92. It is arranged that the threshold force required to move the control element 86 to its inactive position as shown in FIG. 7 is greater than will be experienced during normal drilling operations, but is less than the force which would damage the steering component.

Accordingly, in the presence of a lateral force which exceeds the threshold, the articulating body 146 can be forced to pivot, overcoming the resistance of the detent mechanisms 92 and the bias of the spring 90, and driving the control element 86 to the right as drawn, to its inactive condition as shown in FIG. 7. It will be understood that the cupped shape of the control element 86 is such that the spring 90 is acting to force the articulating body 146 to its linear position, so that the articulating component 146 can automatically resume its active condition when the excessive force has ceased.

Figure 8:
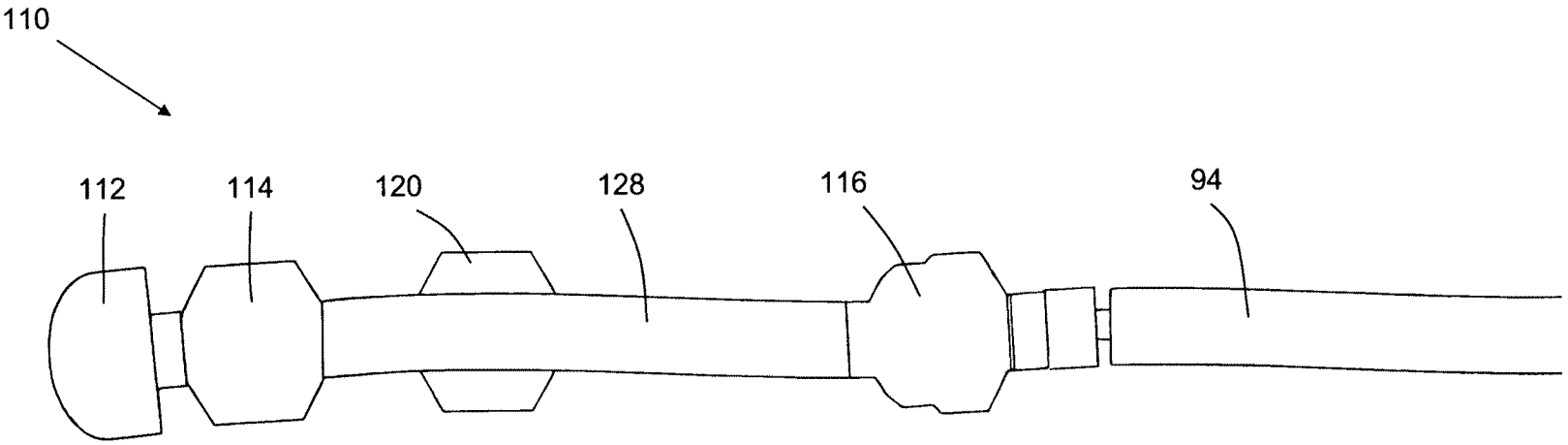
FIG. 8 shows a side view of an alternative downhole steering assembly according to the present invention, during drilling of a curved section of borehole.

FIG. 8 depicts an alternative downhole steering assembly 110 comprising a drill bit 112, a near-bit stabiliser 114, a steering component 120, an articulating component 116 and a downhole motor 94. In this embodiment the steering component 120 is sufficiently robust not to require an articulating component between it and the drill bit 112, but in other embodiments a further articulating component could be used if desired.

The steering component 120 causes the shaft or barrel collar 128 to bend as it is forced away from the longitudinal axis of the borehole, in known fashion. The neat-bit stabiliser 114 also acts as a pivot stabiliser in this arrangement.

The articulating component 116 is located between the steering component 120 and the downhole motor 94, and therefore can prevent excessive or unwanted vibrations being communicated between those components.

It will be understood that the degree of bending of the articulating component (and other parts of the downhole assembly) is exaggerated in the drawings for the purposes of clarity.

The invention claimed is:

1. An articulating component of a downhole assembly, the articulating component having a first end and a second end, the articulating component being adapted to transmit torque between the first end and the second end, the articulating component having a pivotable coupling between its first and second ends and at least one control element for the pivotable coupling, the control element(s) having an active condition in which the pivotable coupling is substantially locked against pivoting movement, and an inactive condition in which the pivotable coupling is unlocked and can pivot substantially freely.

2. The articulating component of claim 1 in which the at least one control element includes a plurality of pistons which are movably located within respective cylinders.

3. The articulating component according to claim 2 in which the cylinders are filled with hydraulic fluid, each cylinder being connected to a circuit for the hydraulic fluid whereby the cylinders can be hydraulically connected.

4. The articulating component according to claim 3 in which the circuit for the hydraulic fluid includes at least one valve, the at least one valve having an open condition in which fluid can flow between the respective cylinders, and a closed condition in which fluid flow between the respective cylinders is substantially prevented.

5. The articulating component according to claim 2 in which a number of the pistons are arranged in a set and are located at spaced locations around the articulating component, the pistons each engaging a part of the pivotable coupling.

6. The articulating component according to claim 5 in which there are three or more pistons in the set substantially equally spaced around the articulating component.

7. The articulating component according to claim 5 in which the pistons in the set are substantially aligned in a single plane.

8. The articulating component according to claim 5 in which the cylinders are filled with hydraulic fluid, each cylinder being connected to a circuit for the hydraulic fluid whereby the cylinders can be hydraulically connected, the circuit for hydraulic fluid including at least one valve, the number of valves being equal to the number of pistons in the set, each valve having an open condition in which fluid can flow between respective cylinders, and a closed condition in which fluid flow between the respective cylinders is substantially prevented.

9. The articulating component according to claim 2 in which at least two pistons are longitudinally aligned in a bank of pistons.

10. The articulating component according to claim 9 in which the respective cylinders of the bank of pistons are in communication by way of a linear fluid conduit.

11. The articulating component according to claim 1 in which the control element is biased to its active condition by a resilient biasing means.

12. The articulating component according to claim 11 in which the control element is retained in its active condition by a detent mechanism.

13. A downhole steering assembly comprising a drill bit, a steering component adapted to deviate the drill bit from a linear path, and an articulating component which is distinct from the steering component, the articulating component being located between the drill bit and the steering component, the articulating component being adapted to transmit torque between the steering component and the drill bit, the articulating component having a first end directed towards the steering component and a second end directed towards the drill bit and a pivotable coupling between its first and second ends, and at least one control element for the pivotable coupling, the control element having an active condition in which the pivotable coupling is substantially locked against pivoting movement, and an inactive condition in which the pivotable coupling is substantially unlocked and can pivot substantially freely.

14. The downhole steering assembly according to claim 13 in which the articulating component is a first articulating component and the downhole steering assembly has a second articulating component, the steering component being located between the first and second articulating components.

15. The downhole steering assembly according to claim 13 in which the pivotable coupling is transferable between its active and inactive conditions independently of the actuation of the steering component.

16. A downhole steering assembly for connection to a drill string, the assembly comprising a drill bit, a steering component adapted to deviate the drill bit from a linear path, and an articulating component which is distinct from the steering component, the steering component being located between the drill bit and the articulating component, the articulating component having a first end directed towards the drill string and a second end directed towards the steering component and being adapted to transmit torque between its first and second ends, the articulating component having a pivotable coupling between its first and second ends and at least one control element for the pivotable coupling, the control element having an active condition in which the pivotable coupling is substantially locked against pivoting movement, and an inactive condition in which the pivotable coupling is substantially unlocked and can pivot substantially freely.

17. The downhole steering assembly according to claim 16 in which the articulating component is a first articulating component and the downhole steering assembly has a second articulating component, the steering component being located between the first and second articulating components.

18. The downhole steering assembly according to claim 16 in which the pivotable coupling is transferable between its active and inactive conditions independently of the actuation of the steering component.

19. A method of operating a downhole tool, the downhole tool comprising an articulating component and at least one sensor, the articulating component having a first end and a second end and being adapted to transmit torque between its first and second ends, the articulating component having a pivotable coupling between its first and second ends and at least one control element for the pivotable coupling, the method including the steps of:

detecting vibrations within the tool by way of the at least one sensor;

comparing the vibrations with a predetermined threshold;

maintaining the control element in an active condition in which the pivotable coupling is substantially locked against pivoting movement whilst the detected vibrations remain below the predetermined threshold; and transferring the control element to an inactive condition in which the pivotable coupling is substantially unlocked and can pivot substantially freely if the vibrations exceed the predetermined threshold.

20. The method according to claim 19 in which the control element is subsequently transferred from its inactive condition to its active condition when the detected vibrations fall below the predetermined threshold.

21. The method according to claim 19 in which the downhole tool has a controller, in which the predetermined threshold is stored in the controller, and in which the step of comparing the detected vibrations with the predetermined threshold is undertaken within the tool.

22. The method according to claim 21 in which the controller is in communication with surface equipment, the method including the step of issuing a signal from the surface equipment to switch the downhole tool from a first operating mode to a second operating mode, the control element in the first operating mode being transferred between its active and inactive conditions by the controller, the control element in the second operating mode being transferred between its active and inactive conditions by the surface equipment.

23. The method according to claim 22 including the further step of issuing a separate signal from the surface equipment to switch the downhole tool from the second operating mode to the first operating mode.

24. The method according to claim 19 in which the downhole tool is connected to surface equipment, and in which a signal is sent to the surface equipment when the predetermined threshold is exceeded.

25. The method according to claim 24 in which the control element is subsequently transferred from its inactive condition to its active condition upon receipt of a signal from the surface equipment.

* * * * *